United States Patent [19]

Gale et al.

[11] 4,259,169

[45] Mar. 31, 1981

[54] PROCESS FOR THE SEPARATION OF N-PARAFFINS FROM HYDROCARBON OILS

[75] Inventors: Sidney T. G. Gale, Awali, Bahrain; Paula J. J. Spreutels, Ghent, Belgium

[73] Assignee: s.a. Texaco Belgium n.v., Brussels, Belgium

[21] Appl. No.: 42,665

[22] Filed: May 25, 1979

[51] Int. Cl.[3] ..... C10G 73/24

[52] U.S. Cl. ..... 208/25; 260/96.5 C

[58] Field of Search ..... 208/25; 260/96.5 R, 260/96.5 C

[56] References Cited

U.S. PATENT DOCUMENTS

| | | | |
|---|---|---|---|
| 2,681,302 | 6/1954 | Gorin | 260/96.5 R |
| 2,890,161 | 6/1959 | Brown et al. | 208/25 |
| 2,911,350 | 11/1959 | Kerns | 208/25 |

*Primary Examiner*—Herbert Levine

*Attorney, Agent, or Firm*—Carl G. Ries; Robert A. Kulason; Robert Knox, Jr.

[57] ABSTRACT

A process for the separation of n-paraffins from hydrocarbon by means of solid urea wherein the formation of the adduct of n-paraffins with urea is carried out in a fluidized bed.

13 Claims, 1 Drawing Figure

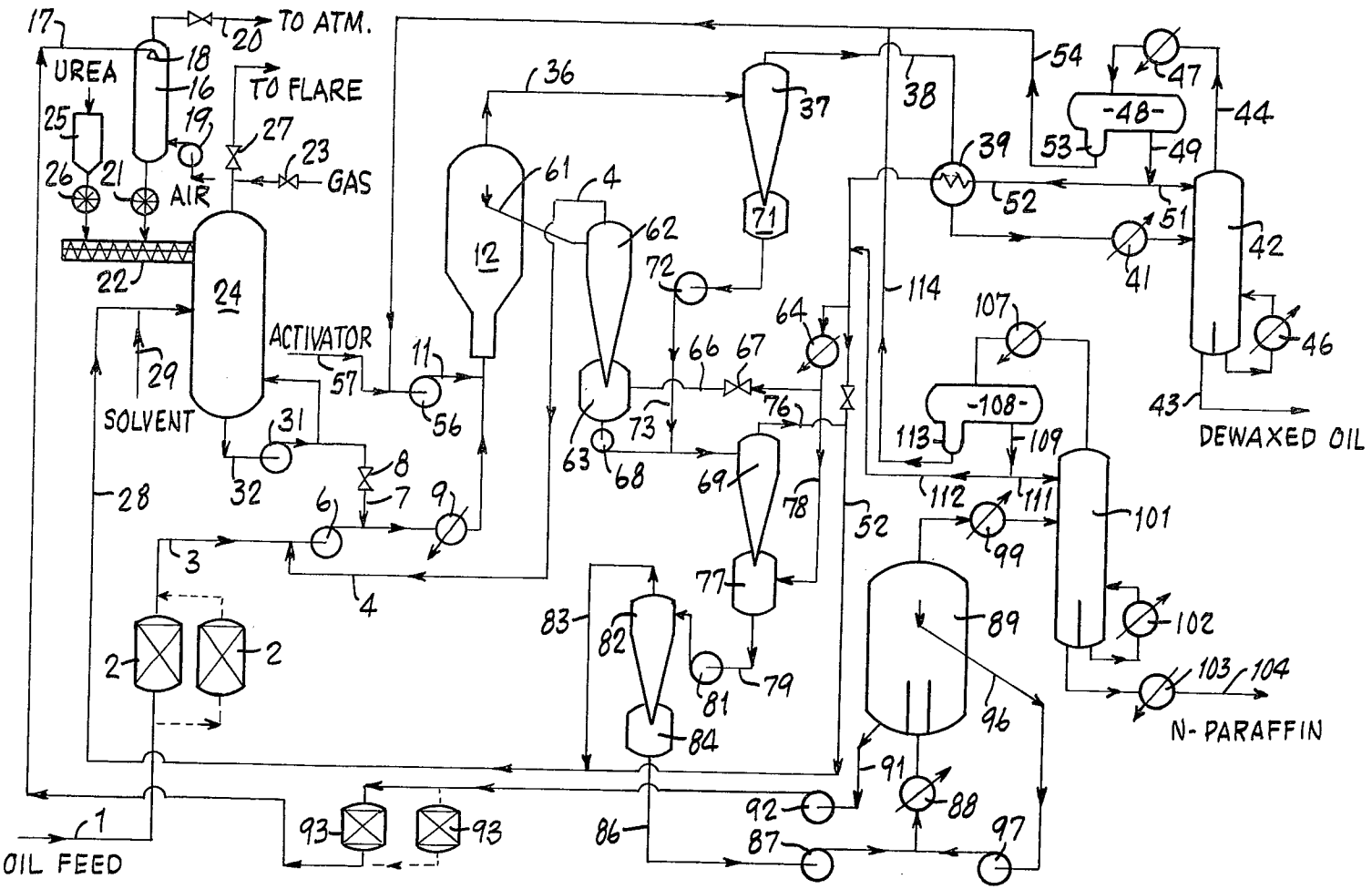
DEWAXED OIL
N-PARAFFIN
TO ATM.
TO FLARE
GAS
AIR
UREA
ACTIVATOR
SOLVENT
OIL FEED

PROCESS FOR THE SEPARATION OF N-PARAFFINS FROM HYDROCARBON OILS

This invention relates to a process for the separation of n-paraffins from hydrocarbon oils by means of solid urea. In one of its more specific aspects, this invention relates to a process for the formation of adducts of urea and n-paraffins in a fluidized bed adduction zone wherein solid urea in particle form is maintained as a dense phase fluidized bed in which the fluidizing medium is a liquid hydrocarbon mixture undergoing treatment for the separation of n-paraffins therefrom.

The separation of n-paraffins from mixtures of hydrocarbons by the urea adduct process is generally well known. Petroleum distillates, such as kerosene, gas oil, and lubricating oil stocks, containing n-paraffin hydrocarbons having at least six carbon atoms per molecule may be treated in a urea adduct process for the extraction of n-paraffins from other components of the hydrocarbon mixture. The process is effective for the dewaxing of hydrocarbon distillates for the production of fuels and lubricating oil stocks having low pour points and for the production of high purity normal paraffins. Recently, the demand for n-paraffins of relatively high purity for the production of biodegradable sulfonate detergents and for the production of sodium glutamate and edible proteins has become commercially important.

It is well known that urea reacts with n-paraffins containing more than five carbon atoms per molecule to form crystalline inclusion compounds or urea adducts, and that the higher molecular weight n-paraffins are preferentially adducted by urea. Adducts of urea generally consist of about 25 percent by weight n-paraffins and 75 percent by weight urea. Formation of the adduct is facilitated by the presence of a small amount of a polar compound, such as alcohol or water, known as an activator. The complex or adduct is formed at ordinary temperatures and may be decomposed by heating to a temperature of the order of 65° to 80° C. (150° to 180° F.). The complex may be decomposed by heat alone or by solution of the urea in a suitable solvent, such as water, followed by crystallization of the urea from solution at lower temperatures, for example, at 20° C. (68° F.).

A hydrocarbon oil feedstock undergoing processing may be contacted with crystalline urea by simply mixing the solid urea with the hydrocarbon oil to permit adduct formation to occur and then filtering the adduct from the treated oil. Alternatively, the oil undergoing treatment may be percolated through a fixed bed of crystalline urea or a bed of solid carrier material on which crystalline urea is deposited. A non-adduct-forming solvent, such as a lower molecular weight alkane or halogenated derivative thereof, may be used to reduce the viscosity of the charge oil and recovered n-paraffins.

Recovery of n-paraffins from the urea adduct may be carried out in a fixed bed reactor by circulating heated solvent, such as propane, butane, pentane, isobutane, isopentane, isohexane, or halogenated hydrocarbons, such as dichloromethane, dichlorofluoromethane, and the like through the bed as disclosed in U.S. Pat. Nos. 2,640,051 and 3,163,632. Decomposition of urea adduct in a fluidized bed to prevent melting of the urea is disclosed in U.S. Pat. No. 2,619,501.

In accordance with the process of the present invention, the treatment of the oil charge and the formation of the adduct is carried out in a novel manner in a fluidized bed reaction zone. We have discovered reaction conditions effective for the formation of the adduct in a fluidized bed and, at the same time, for maintaining the urea and the resulting adduct in non-agglomerating particle form permitting the use of a fluid bed with its inherent temperature control advantages in the formation of the adduct.

Decomposition of the adduct is carried out in a novel manner also. After separation of the adduct from oil undergoing processing, and washing with a non-adduct-forming solvent if a pure n-paraffin product is desired, the adduct is decomposed and the urea melted by heating to a temperature above the melting point of urea, preferably in the range of 132° to 138° C. The process of this invention will be more fully understood by reference to the accompanying FIGURE and the following detailed description of a preferred embodiment of the present process.

Various activators for promoting the rate of formation of the urea-n-paraffin adduct are known. Such activators include water and the lower alcohols, ketones, and ethers, e.g., methanol, ethanol, acetone, methyl ethyl ketone, propanol, secondary butyl alcohol, dimethyl ether, diethyl ether, and methyl ethyl ether. Water is undesirable in the present process in that it tends to cause agglomeration of the solid particles of urea and urea adduct in the fluidized bed adduct formation zone. Preferred activators for the present process are methanol and ethanol. While both are effective, methanol is generally preferred because of its low cost and ready availability.

The accompanying drawing represents diagrammatically a preferred mode of carrying out the process of this invention.

With reference to the drawing, an oil feed stream undergoing treatment enters the system through line 1 and is passed through a drier 2 for the removal of any water contained in the feed stream. The drier 2 comprises preferably a bed of solid desiccant, such as silica gel, contained in a plurality of vessels so arranged that while the oil feed passes through one of the vessels, the desiccant may be regenerated in another. The dried oil feed stream is passed through line 3 and is admixed with recycled oil from line 4 and the mixture passed through pump 6 into admixture with a slurry of prilled solid urea in a hydrocarbon solvent introduced into the oil feed stream from line 7 as controlled by valve 8. The resulting mixture of solvent, solid urea, and oil is cooled to the desired adduct formation temperature by chiller 9, admixed with activator from line 11, and introduced into the lower portion of a fluidized bed reaction zone 12. The activator utilized in this process is preferably selected from the group consisting of methanol and ethanol.

In the fluidized bed adduct forming reaction zone 12, the prilled urea and the resulting urea-n-paraffin adduct in particle form are maintained in a dense phase fluidized bed by the fluidizing action of the upwardly flowing stream of hydrocarbon oil and solvent passing through the bed. Dense phase fluidized bed operations are well known in the art of petroleum processing and in various separations processes.

The prilled urea utilized in the process is produced by cooling and crystallization of drops of molten urea in a prilling tower 16 in a known manner. Molten urea recovered from the process in the adduct decomposition zone, later described, is introduced through line 17 into the upper part of a prilling tower 16 where it is sprayed by a suitable nozzle 18 or other drop forming device which disperses the molten urea into an upwardly flowing stream of air as discrete particles or drops which are permitted to fall free within tower 16 countercurrent to a cooler air stream. The air simultaneously cools the urea to a solid bead or particle form so that by the time the urea reaches the bottom of the tower the drops have solidified into discrete, free-flowing particles of solid urea. Air is introduced into the lower part of the column by blower 19 and discharged from the upper part of the column through line 20 to the atmosphere. The upwardly flowing air stream serves to remove heat during the cooling and crystallization of the urea in tower 16 and to retard the rate of descent of the particles of urea. Prilled urea is withdrawn from the bottom of tower 16 and fed at a controlled rate by star feeder 21 to a screw conveyor 22 which transfers the urea to a slurry vessel 24 for the preparation of a slurry in solvent. Make-up urea in free-flowing bead or pellet form is supplied to the system as necessary from storage hopper 25 at a rate as controlled by a star feeder 26.

Slurry vessel 24 may be purged with gas from a suitable source as controlled by valve 23 and may be depressured by venting to the atmosphere or to a flare as controlled by valve 27.

In the slurry vessel 24, the prilled urea is suspended in a suitable solvent or diluent for the oil undergoing treatment. The solvent or diluent preferably comprises a light hydrocarbon containing 3 to 6 carbon atoms per molecule, as described hereinabove. Isohexane is a preferred solvent for the present process. The solvent is supplied to the slurry vessel from a line 28 as a recycle stream in the process as described hereinafter. Make-up solvent from a suitable source is supplied to the system as needed through a supply line 29. A suspension of prilled urea in liquid solvent is prepared by simply mixing the solvent with the particles of solid urea. The agitation or mixing required to produce a uniform slurry is effected in this case by pump 31 which withdraws slurry from the slurry vessel through line 32 and returns a part of the slurry to the vessel through line 33. The prilled urea slurried in solvent is introduced into the feed stream as needed through line 7 as controlled by valve 8, previously mentioned.

The removal of n-paraffins from the feed stream by the formation of an adduct with solid urea takes place in a fluidized bed reaction zone 12. Treated oil, i.e., oil from which n-paraffins have been removed, is discharged from the upper portion of the fluidized bed reaction zone 12 through line 36 to a cyclone separator 37 wherein any solid urea or adduct carried over from the fluidized bed reaction zone is separated from the treated oil. The treated oil is discharged from the upper part of the cyclone separator 37 through a line 38 to a heat exchanger 39 wherein it is heated by indirect heat exchange with solvent recovered from the treated oil as described hereinafter and passed through a heater 41 to a fractional distillation column 42 for the separation of promoter and solvent from the treated oil.

The fractional distillation column 42 preferably is provided with the usual multiple trays for repeated countercurrent contact between liquid flowing down the column and vapors flowing upwardly through the column. Treated oil is removed from the bottom of the column 42 through line 43 as a product of the process while the more volatile solvent and activator are withdrawn overhead through line 44 as vapors. Heat for effecting the distillation is supplied at the base of the column 42 by a suitable heater 46.

The vapors passing overhead from the fractional distillation column 42 through line 44 are cooled and condensed in a condenser 47 and the condensate collected in an accumulator-separator 48 wherein the solvent and activator are separated from one another by gravity separation. Solvent is withdrawn from the separator 48 through line 49. Part of the solvent is returned to the upper part of fractional distillation column 42 through line 51 as reflux for the column while the remainder is passed through a line 52 and the heat exchanger 39 as recycle to the process. The activator, for example methanol, is withdrawn from a boot 53 at the bottom of separator 48 and passed through a line 54 to a pump 56 for recycle to the fluidized bed reaction zone 12 via line 11, previously mentioned. Fresh promoter required to make up losses from the system is supplied from a suitable source through line 57.

As urea adduct is formed in the fluidized bed reactor 12 by adduction of n-paraffins, the particles of urea tend to increase in size so that they become more bouyant than the average particles in the fluidized bed. These urea adduct particles tend to concentrate in the upper portion of the fluidized bed and are withdrawn from the top of the bed through line 61 together with some of the processed oil. Urea adduct, urea, and processed oil drawn from the fluidized bed reactor 12 through line 61 are introduced into cyclone separator 62 wherein the solid urea adduct is separated from the mixture of treated oil, solvent, and promoter. Treated oil, in admixture with solvent and activator, is withdrawn from the upper part of the cyclone separator 62 through a flow line 4 and recycled into admixture with fresh feed from line 3 as previously mentioned.

Solid urea adduct separated from the treated oil in the cyclone separator 62 is collected in an accumulator 63. Clean solvent from fractional distillation column 42 after cooling in the heat exchanger 39 is passed through a transfer line 52 to a cooler 64 and then introduced through a supply line 66 into the accumulator 63 as controlled by valve 67 as a wash liquid. The resulting slurry of urea adduct in solvent is passed by a pump 68 into a cyclone separator 69. Fine particles of urea and adduct carried overhead from the fluidized bed reactor 12 via the line 36 and separated by the cyclone separator 37 are withdrawn from an accumulator 71 associated therewith and passed by a pump 72 through a line 73 into the cyclone separator 69 together with the urea adduct from the cyclone separator 62.

In the cyclone separator 69, solid urea and urea adduct are separated from the liquid solvent and any residual oil carried over from the fluidized bed reactor 12 on the surface of the urea and urea adduct. The separated wash solvent containing oil washed from the solid adduct is withdrawn from the upper part of the cyclone separator 69 through a line 76 and recycled to the slurry vessel 24. The washed adduct separated from the solvent in the cyclone separator 69 is contracted in its accumulator 77 with an additional quantity of chilled, fresh solvent from a line 78 and the mixture of fresh solvent and adduct passed through a flow line 79 by a pump 81 to a final cyclone separator 82. Solvent, containing any remaining oil washed from the adduct, is separated from the oil-free adduct in the cyclone separator 82. The solvent is withdrawn from the upper portion of the cyclone separator 82 through a flow line 83 and the adduct, substantially completely free from nonadduct forming components of the oil, is collected in the accumulator 84. The twice washed adduct is withdrawn from the accumulator 84 through a line 86 as a slurry in wash solvent by pump 87, admixed with hot n-paraffin, and passed through a heater 88 into an adduct decomposition zone 89 wherein the adduct is decomposed and the urea melted by heating to a temperature above its melting point, i.e., above about 133° C. (271° F.). Hot n-paraffin separated from the molten urea is withdrawn from the upper portion of adduct decomposer 89 through line 96, by pump 97, admixed with adduct, solvent, and promoter from line 86 and the mixture passed through heater 88 which supplies heat for the decomposition of the adduct and melting of the urea.

Molten urea is withdrawn from the adduct decomposition zone 89 through a line 91 and passed by a pump 92 through a filter 93 to the line 17 for introduction into the prilling tower 16 as mentioned hereinabove. Filters 93 are constructed and arranged so that they may be used alternately with provision for cleaning one of the filter beds while another is in use.

The solvent and activator are vaporized in the adduct decomposer-urea melter 89. N-paraffin, solvent and activator vapors are discharged from the upper portion of the adduct decomposition zone 89 to a feed preheater 99 and introduced into a fractional distillation column 101 wherein n-paraffin product is separated from the solvent and promoter. Heat for effecting the distillation is supplied at the base of the fractional distillation column 101 by a suitable heater 102. N-paraffin is withdrawn as bottom product from the column, cooled in cooler 103 and discharged through line 104 as a product of the process. Overhead vapors from the distillation column 101 are discharged through line 106 to a condenser 107 wherein the vapors comprising solvent and promoter are cooled and condensed to liquid phase and collected in an accumulator-separator 108.

The solvent and the promoter are partially immiscible and are separated from one another by gravity in the separator 108. The condensed solvent is withdrawn through a line 109; part of the solvent is returned to the fractional distillation column 101 through a reflux line 111 as reflux for the column. The fractional distillation column preferably is provided with a number of trays having provision for multiple countercurrent contact between liquid and vapor in the column. The remainder of the solvent is passed through line 112 into admixture with solvent recovered from the dewaxed oil by fractional distillation column 42 for recycle to the process. As described hereinabove, the solvent is utilized in washing of the adduct in the accumulators 63 and 77 and for dilution of the oil feed to the process via line 28 and slurry vessel 24. Activator, separated by gravity from the solvent, is withdrawn from a boot 113 of the accumulator 108 and passed through a line 114 into admixture with activator recovered in the fractional distillation column 42. Activator is returned to the process by the pump 56 and the line 11.

We have found that certain conditions are necessary for successfully carrying out the adduct forming reaction between solid urea and n-paraffins in a fluidized bed reactor. In general, the concentration of the activator, e.g., methanol, in the hydrocarbon mixture undergoing treatment, i.e., the oil, the diluent if a diluent is present, and activator, should be in the range of from about 1 to about 3 percent by volume. The quantity of activator has a major influence on the activation time, i.e., the time required for adduction to occur. In general, and within limits, the activation time decreases as the activator concentration is increased. Using methanol as an activator, it was found that methanol concentrations below about 1 percent by volume are relatively ineffective as activators. The adduction rate and the extent of n-paraffin adduction, as indicated by the refractive index of the treated oil, increased as methanol concentration was increased in the range of 1 to 3 percent by volume of the hydrocarbon mixture.

We have found that good adduction can be accomplished in a fluidized bed adduction zone with a methanol concentration of the order of 1 percent by volume of the hydrocarbon mixture in a period of time within the range of 20 to 30 minutes. Comparable results may be obtained with a contact time in the range of 14 to 20 minutes with a methanol concentration of approximately 2 percent by volume, and in the range of 8 to 20 minutes with a methanol concentration of approximately 3 percent by volume. Increasing the methanol concentration above about 3 percent by volume results in deterioration of the fluidized bed.

The term "hydrocarbon mixture" as used herein, includes not only the hydrocarbon oil charge stock, but also the diluent and the activator, all of which comprise the liquid phase in the fluid bed adduction zone. For convenience, mixtures of hydrocarbons comprising both n-paraffins and other hydrocarbon types, including kerosene gas oil and lubricating oil base stock fractions of petroleum distillates are sometimes referred to herein simply as "oil".

The rate of adduction of n-paraffins with urea increases as the urea to oil ratio is increased. Good results are obtained with a dosage or urea to oil within the range of 0.4 to 0.5 kilograms of urea per liter of oil.

Diluents may be used in the process to reduce the viscosity of the oil undergoing treatment and improve fluidization in the fluidized bed adduction zone. In general, dilution reduces the reaction velocity and hence increases the residence time which must be maintained in the fluidized bed to obtain a given level of n-paraffin adduction. Dilution of a diesel fuel fraction having a refractive index of 1.47450 with isohexane in a laboratory test indicated that the oil undergoing treatment could be diluted to a concentration as low as about 5 percent oil by volume (95 volume percent diluent) while maintaining an activation time in the range of 11 minutes, thus indicating that a wide range of dilution is possible without detriment to the process.

The process should be carried out under essentially anhydrous conditions. For this reason it is desirable to pass the oil feedstock through a drier before it is introduced into the fluidized bed reactor.

EXAMPLE

A laboratory scale pilot plant employing a fluidized bed of prilled urea was operated for dewaxing middle distillate oils in the kerosene and atmospheric gas oil boiling ranges. Tests were carried out in a column having a height of 75 centimeters and an internal diameter of 7.7 centimeters equipped with an outlet for treated oil at its top and an axially disposed outlet tube for withdrawal of adduct at a height of 57.5 centimeters above the bottom of the column. The adduct outlet tube had a diameter of 1.3 centimeters. The arrangement of the column was essentially that illustrated in the accompanying drawing. The bottom of the column was provided with a perforated glass distributor plate having a plurality of holes 0.4 mm in diameter through which the hydrocarbon mixture was introduced into the lower end of the fluidized bed.

A hydrotreated heavy diesel fuel fraction having an atmospheric boiling range of 293° C. to 360° C. (560° F.–680° F.) and a refractive index of 1.47381 from an Arabian Light crude oil was treated in the fluidized bed laboratory scale pilot plant reactor to evaluate the effectiveness of the fluidized bed reactor for dewaxing middle distillate oils. To 500 cc of the diesel fuel were added 3.9 liters isohexane diluent and 150 cc of methanol as activator. 200 g of prilled urea were added to the reactor and the hydrocarbon mixture (feedstock, diluent and activator) passed upwardly through the column at the rate of 4 liters per minute forming a dense phase fluidized bed within the column with a distinct upper level of the bed well below the outlet for the treated hydrocarbon mixture.

The dense phase fluidized bed occupied approximately 75 percent of the total height of the liquid column. In conducting the tests, treated hydrocarbon mixture substantially free from urea and urea adducts was withdrawn from the top of the column and recycled to the bottom of the column. The extent of n-paraffin removal was determined by determining the refractive index of samples of the treated hydrocarbon mixture at intervals during the test run. At the end of 10 minutes, the refractive index of the diesel fuel had increased from 1.47381 to 1.47743 and at the end of 20 minutes to 1.47860.

Fluidization of the prilled urea (average diameter of about 2 mm) was smooth and trouble free. The adduct formed by the fluidized bed urea adduction process using methanol as activator was not sticky and was easily slurried and pumped. The test was carried out at a temperature of about 20° C. Circulation of the hydrocarbon mixture was discontinued and the bed permitted to stand for several hours. When circulation of the hydrocarbon mixture was resumed, the settled bed of prilled urea was easily fluidized.

Calculation of wax purity by a modified Watson and Nelson characterization factor method based on congealing point and specific gravity measurements indicated purities of 90 to 95 percent for the n-paraffin produced by the fluidized bed adduction process of this invention as compared with 85 to 90 percent purity for wax obtained by a urea dewaxing procedure using an aqueous urea solution and dichloromethane solvent.

It is evident that the process of this invention possesses a number of advantages over conventional processes employing solid urea for dewaxing or n-paraffin production.

We claim:

1. A process for forming an adduct of urea and a normal paraffin which comprises passing a liquid hydrocarbon mixture comprising n-paraffins having at least 6 carbon atoms per molecule, non adduct-forming hydrocarbons, and from 1 to 3 volume percent of a monohydric alcohol having from 1 to 2 carbon atoms per molecule upwardly through a contacting zone into contact with solid particles of urea at a flow rate sufficient to fluidize said particles of urea without substantial entrainment in said liquid hydrocarbon mixture thereby maintaining a dense phase fluidized bed of solid urea particles in said contacting zone, said bed having a distinct upper level below the outlet for the treated hydrocarbon mixture and effecting the formation of solid urea-n-paraffin adduct with at least a portion of the n-paraffins contained in said hydrocarbon mixture, said adduct tending to concentrate in the upper portion of said fluidized bed; withdrawing treated hydrocarbon mixture depleted in n-paraffins at a point above the upper level of said dense phase fluidized bed and withdrawing said adduct from the upper portion of said dense phase fluidized bed.

2. A process according to claim 1 wherein said hydrocarbon mixture comprises a middle distillate oil and a non-adduct forming light hydrocarbon diluent.

3. A process according to claim 1 wherein said alcohol is methanol.

4. A process according to claim 1 wherein said alcohol is dissolved in said hydrocarbons prior to contacting said hydrocarbon mixture with urea.

5. A process according to claim 1 wherein said contacting zone is maintained at a temperature in the range of 7° C. to 21° C.

6. A process according to claim 1 wherein said hydrocarbon mixture comprises kerosene and methanol, the process is carried out at a temperature in the range of 11° C. to 13° C.

7. A process according to claim 1 wherein said hydrocarbon mixture comprises mixed iso-paraffins containing 4 to 6 carbon atoms per molecule and said reaction is maintained at a temperature in the range of 7° C. to 21° C.

8. A process according to claim 1 wherein said hydrocarbon mixture comprises a waxy gas oil and a non-adduct forming light hydrocarbon diluent containing from 3 to 6 carbon atoms per molecule.

9. A process according to claim 1 wherein said adduct recovered from said n-paraffin depleted hydrocarbon mixture is washed with a non-adduct forming hydrocarbon containing from 3 to 6 carbon atoms per molecule.

10. A process for the separation of n-paraffins from a hydrocarbon distillate containing same which comprises forming a mixture of said hydrocarbon Distillate, a non-adduct forming diluent and from 1 to 3 volume percent of a low molecular weight monohydric alcohol containing 1 to 2 carbon atoms per molecule, passing said mixture upwardly through a dense phase fluidized bed of solid urea particles having a distinct upper level, effecting removal of n-paraffins from said hydrocarbon distillate by formation of urea adduct thereby improving the pour point of said hydrocarbon distillate; withdrawing said hydrocarbon distillate of improved pour point at a point above the upper level of said dense phase fluidized bed, withdrawing solid urea and solid urea adduct from the upper portion of said fluidized bed; heating said solid urea adduct above the melting point of urea thereby decomposing said adduct and liberating n-paraffins; separating n-paraffins from said molten urea; prilling said molten urea; and returning said prilled urea to said adduct-forming fluidized bed.

11. A process according to claim 10 wherein said low molecular weight alcohol is methanol.

12. A process according to claim 10 wherein said solid urea adduct is heated to a temperature in the range of 132° to 138° C. to effect decomposition of said adduct and melting of urea.

13. The process of claim 10 in which the withdrawn hydrocarbon distillate is subtantially free from urea and urea adduct.

* * * * *